US006840891B2

(12) United States Patent
Publicover

(10) Patent No.: US 6,840,891 B2
(45) Date of Patent: Jan. 11, 2005

(54) TRAMPOLINE SYSTEM WITH SYSTEMATICALLY PHASED SPRING ELEMENTS

(76) Inventor: Mark W. Publicover, 18505 Marshall La., Saratoga, CA (US) 95070

( * ) Notice: Subject to any disclaimer, the term of this patent is extended or adjusted under 35 U.S.C. 154(b) by 204 days.

(21) Appl. No.: 10/110,884

(22) PCT Filed: Aug. 14, 2001

(86) PCT No.: PCT/US01/25544

§ 371 (c)(1),
(2), (4) Date: Apr. 15, 2002

(87) PCT Pub. No.: WO02/13914

PCT Pub. Date: Feb. 21, 2002

(65) Prior Publication Data

US 2003/0036460 A1 Feb. 20, 2003

Related U.S. Application Data

(60) Provisional application No. 06/225,135, filed on Aug. 14, 2000.

(51) Int. Cl.[7] ..... A63B 5/11
(52) U.S. Cl. ..... 482/27
(58) Field of Search ..... 482/23, 27–29

(56) References Cited

U.S. PATENT DOCUMENTS 4,162,063 A 7/1979 Nissen et al.
4,225,131 A 9/1980 Sidlinger et al.
5,069,445 A 12/1991 Mai

*Primary Examiner*—Glenn E. Richman
(74) *Attorney, Agent, or Firm*—Klarquist Sparkman, LLP

(57) ABSTRACT

Springs (10) or other elastic connectors used to support a bed (14) within the frame of a trampoline or the like are attached using methods that systematically vary the tension (or the travel distance required to reach limit of elasticity) between adjacent (or sets of adjacent) springs (10). These spring attachment methods increase the time it takes a given trampoline to absorb a given amount of energy, increasing the shock absorption time and thereby reducing the likelihood of an injury.

17 Claims, 1 Drawing Sheet

TRAMPOLINE SYSTEM WITH SYSTEMATICALLY PHASED SPRING ELEMENTS

This is the National Stage of International Application No. PCT/US01/25544, filed Aug. 14, 2001, which claims the benefit of U.S. Provisional Application No. 60/225,135, filed Aug. 14, 2000, which applications are incorptrated herein by reference.

The present invention concerns jumping surfaces used with trampolines to protect trampoline users from injury, and to provide new uses for trampolines. In the past, trampolines have been used for a variety of athletic and recreational purposes. However, thousands of injuries have resulted when persons jumping on a trampoline have landed on the rebounding surface while in an awkward or incorrect body position. These "on-bed" injuries, according to some medical studies, represent the majority of trampoline-related emergency room visits. The U.S. Consumer Products Safety Commission (CPSC) reports that in 1999 approximately 110,000 people were treated in emergency rooms for trampoline related injuries. Even though this number is half that of playstructure/swingset injuries, some in the medical community have called for a ban on the sale of backyard trampolines. The CPSC and the AAOS have taken a more responsible and measured approach to problem. Recognizing that other outdoor activities that are more injurious, like bicycling, would fill the void left by backyard trampoline play, these organizations have instead called for safety improvements to help reduce the disturbingly large number of trampoline injuries.

One approach to reducing trampoline injuries has been to form a wall around the perimeter of a trampoline bed so that when a jumper lands too near the edge, the wall prevents the jumper from falling off. Examples are shown in U.S. Pat. Nos. 5,399,132 and 6,053,845. However, these devices do not directly address injuries that result when users impact the rebounding surface incorrectly or while in an awkward position. A second approach, the use of a harness (worn by the jumper) suspended by elastic cords above the rebounding surface, is an effective way to reduce on-bed, or rebound surface impact injuries. However, such harnesses are designed for safely teaching users advanced acrobatics on high-performance competition trampolines by trained professionals, making them largely inappropriate for low-performance backyard trampolines that are used almost entirely for basic jumping activities and not for advanced acrobatics.

All things being equal, a bed with less tension is more forgiving when a jumper first contacts its surface, it absorbs the impact more slowly and will thus reduce the severity and quantity of on-bed injuries. Nevertheless injuries suffered during an impact with the rebounding surface are still occurring in large numbers on backyard trampoline beds even though these beds are designed to be less responsive and to have less initial surface tension than gymnastic grade, competition trampoline beds. Reducing bed-impact injuries, especially those that occur on backyard trampolines, was the purpose of the present invention, though the art can be used with all trampolines.

Low performance backyard trampolines are used very differently than high performance trampolines used by skilled competitors for training and competition. For instance, many on-bed backyard trampoline injuries occur when multiple jumpers are using the trampoline at the same time as reported in the NEISS data compiled by the CPSC. Because children enjoy playing together most families allow more than one child to jump at the same time even though this practice is strongly discouraged by trampoline manufacturers, the CPSC, and others experts. Competition trampolines are used almost exclusively in disciplined environments for the structured teaching of specific skills. In contrast, backyard trampolines are largely used for fun, unstructured, imaginative play activities that are relished by kids and recommended by child development experts who understand that daily physical activity significantly enhances learning ability and that kids need activities to counterbalance today's over-structured and sedentary lifestyles. Unfortunately, these unstructured trampoline activities generate numerous on-bed injuries when jumpers land on the rebounding surface in an awkward body position or when a jumper lands on a trampoline bed that has been preloaded with the energy from other jumper impacts.

There thus remains a need to significantly reduce the quantity and severity of on-bed injuries that result from such playful activities.

DETAILED DESCRIPTION

Figure 1:
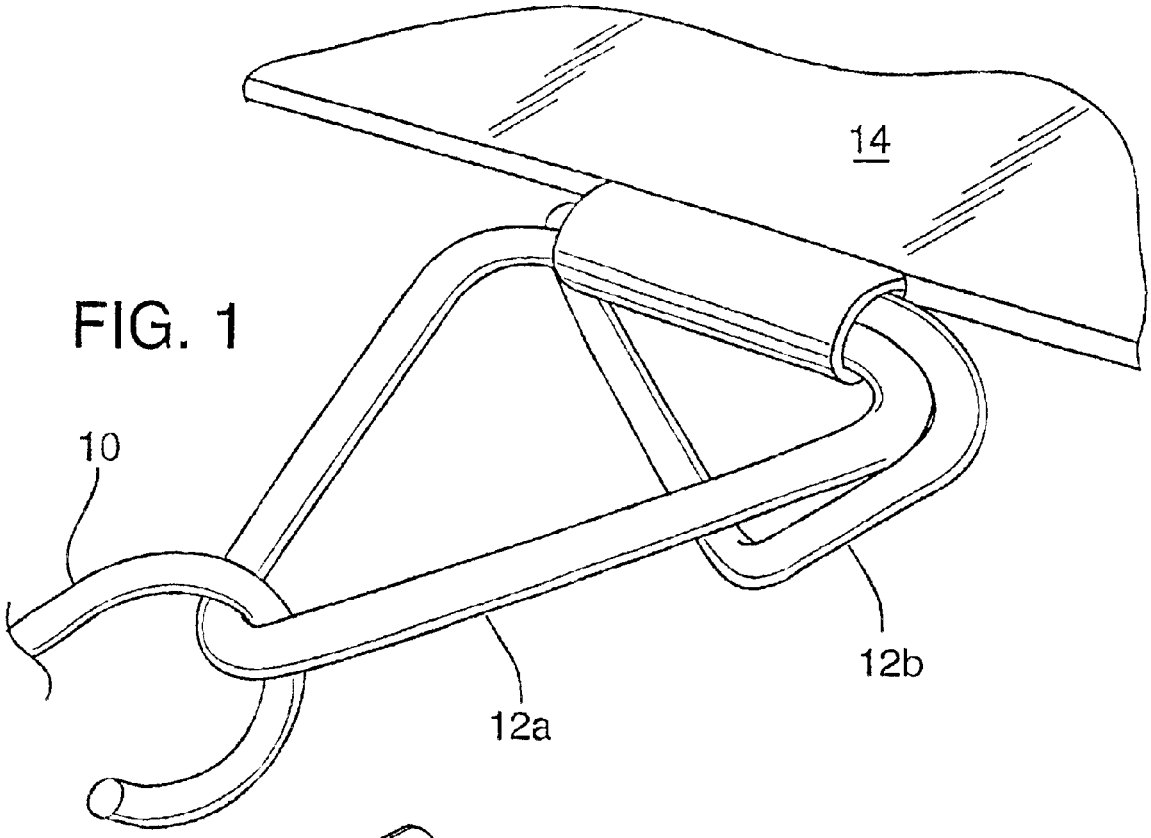
FIG. 1 is an oblique view of a dual position fastener system.

A system that embodies a new use for adjustable or extendable springs is provided. Completely counter to using adjustable or extendable springs to equalize the tension between all the springs as conceived by the prior systems, the present system uses adjustable springs to systematically vary the tension between the springs. For example, removing most of the tension on every other spring half of the total number of springs) while they are at rest makes the bed safer by changing its rebounding dynamics.

All things being equal, varying the spring tension this way is more effective than the prior art at preventing on-bed injuries that result from multiple jumpers and awkward landings. For instance, many injuries occur when multiple users are jumping a synchronously, a first jumper deflects the bed and loads springs with the energy from his fall and now a second jumper lands on the bed in an awkward position. At this point in time, the bed is highly tensioned (unforgiving) and has just begun moving rapidly upward, recycling the energy loaded into the springs by the first jumper. In this case a bed supported by springs with varied tensions or limits of elasticity could be used to significantly reduce the impact force being experienced by the second jumper, thereby helping to prevent an injury. On a standard trampoline bed it takes less time for the bed to transition from moving down (absorbing energy) to moving up (releasing, recycling energy) precisely because all of the springs are uniformly tensioned and working in concert. On the other hand, a bed using springs that vary in tension takes longer to transition because the springs are not working in concert; half the springs are fully loaded and ready to begin releasing energy while the other half are not fully loaded and still capable of absorbing more energy. With only half of the springs fully loaded, the bed is more forgiving because it can absorb the second jumper's impact more slowly; the bed has a greater capacity to absorb energy more slowly because half of its springs are not fully loaded.

This extended absorption time helps to prevent injuries in three ways: 1) It allows the jumper more time to reposition his body into a less awkward or injury-prone position. 2) It allows more time for the energy from an impact to transfer throughout the body thereby lessening the stress in any localized area. 3) It allows the mat to conform more completely to the user's body; it allows more of the mat to come in contact with the user's body, spreading the load over a larger area and thereby lessening the load on a given area, or point of the body. All things being equal, at any point during a rebound cycle, a bed with varied spring tensions will always be more forgiving (will always take more time to absorb an equal amount of energy) than a standard bed. The primary function of the system is to provide a "softer", more cushioned or better shock-absorbing surface than a traditional bed.

The Springs Are Phased In or Staged

Figure 2:
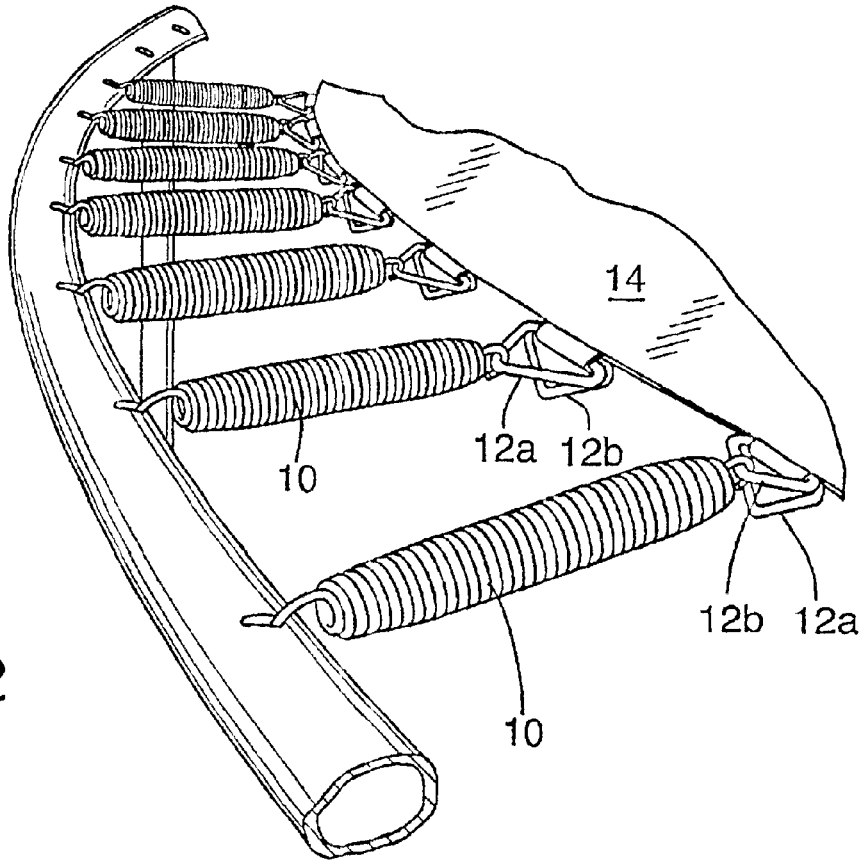
FIG. 2 is an oblique view of the system of FIG. 1 showing the fastener system used on a trampoline.

There are numerous methods for systematically varying the tension (or the travel distance required to reach limit of elasticity) between adjacent (or sets of adjacent) springs 10. In a preferred embodiment, the length of the V-rings 12 or the connectors that are located between the bed and the springs is varied, such as can be seen in FIGS. 1–2, so that every other spring is more (or less) tensioned than the springs on either side of it. Similarly, the V-rings could be configured in repeating sets of three or more with long, middle, and short V-rings. A second embodiment uses two or more springs of the same dimensions except that the length varies. A third embodiment uses springs of various designs (back loaded and not back loaded, weaker and stronger, higher limit of elasticity and lower limit of elasticity). A fourth embodiment uses varied attachment points on the frame or bed; the spring anchor points can be moved in or out relative to the center of the trampoline [the shape of the tubing can be varied (oval, square, triangular) to simplify installation].

A fifth embodiment uses cams of various sizes to alter the rebound dynamics. In each of these embodiments a number of elements can be varied to affect the performance.

What is claimed is:

1. A trampoline system comprising:

a frame;

a bed comprising an expanse of trampoline fabric;

a plurality of springs that extend between the frame and the bed, with the bed connected to the springs at a plurality of positions around the perimeter of the expanse; and fastener elements located to adjust the tension of at least some of the springs that support the bed, the fastener elements having varied characteristics and being systematically arranged such that the tension of the spring elements or the travel distance required to reach the limit of elasticity of the spring elements is not uniform at every position and such that should some of the springs reach the limit of elasticity, adjacent springs or adjacent sets of springs will not have reached the limit of elasticity.

2. A trampoline according to claim 1, wherein:

at least some of the fastener elements comprise V-rings of varied sizes, with one of the V-rings extending between the bed and a spring; and the V-rings are engaged in an arrangement by V-ring size such that the tension or the travel distance required to reach the limit of elasticity is systematically varied between at least some adjacent springs or between at least some adjacent sets of springs such that should some of the springs reach the limit of elasticity, adjacent spring elements or springs of adjacent sets will not have reached the limit of elasticity.

3. A trampoline according to claim 1, wherein:

at least some of the fastener elements comprise cams of various characteristics; and the cams are systematically arranged according to their characteristics in such a manner that the tension of the springs or the travel distance required to reach the limit of elasticity of the springs is not uniform at every position such that should some of the springs reach the limit of elasticity, adjacent springs or springs of adjacent sets will not have reached the limit of elasticity.

4. A trampoline according to claim 1, wherein the fastener elements are systematically arranged by their characteristics such that every spring is tensioned more or less than the spring on either side of it.

5. A trampoline system comprising:

a frame;

a bed comprising an expanse of trampoline fabric; and a plurality of spring elements that extend between the frame and the bed, with the bed connected to the spring elements at a plurality of positions around the perimeter of the expanse and with the static or dynamic tensions of the spring elements being systematically varied between at least some adjacent spring elements or between at least some adjacent sets of spring elements in such a manner that should some of the spring elements reach the limit of elasticity, adjacent spring elements or spring elements of adjacent sets will not have reached the limit of elasticity.

6. A trampoline according to claim 5 wherein some of the spring elements are of different lengths than the others and the spring elements are systematically arranged by length in such a manner that should some of the spring elements reach the limit of elasticity, adjacent spring elements or spring elements of adjacent sets will not have reached the limit of elasticity.

7. A trampoline according to claim 5 wherein some of the spring elements are of different designs than the others and the spring elements are systematically arranged by spring element design in such a manner that should some of the spring elements reach the limit of elasticity, adjacent spring elements or spring elements of adjacent sets will not have reached the limit of elasticity.

8. A trampoline according to claim 7 wherein some of the spring elements are back loaded and other of the spring elements are not back loaded and the spring elements are systematically arranged by back loading characteristic in such a manner that should some of the spring elements reach the limit of elasticity, adjacent spring elements or spring elements of adjacent sets will not have reached the limit of elasticity.

9. A trampoline according to claim 7 wherein some of the spring elements are weaker and other of the spring elements are stronger and the spring elements are systematically arranged by spring element strength in such a manner that should some of the spring elements reach the limit of elasticity, adjacent spring elements or spring elements of adjacent sets will not have reached the limit of elasticity.

10. A trampoline according to claim 7 wherein some of the spring elements have a higher limit of elasticity and other of the spring elements have a lower limit of elasticity and the spring elements are systematically arranged by limit of elasticity in such a manner that should some of the spring elements reach the limit of elasticity, adjacent spring elements or spring elements of adjacent sets will not have reached the limit of elasticity.

11. A trampoline according to claim 5 wherein:

the frame has a plurality of spring attachment points where the spring elements connect to the frame; and some of the attachment points are closer to the center of the trampoline and other of the attachment points are farther from the center of the trampoline and the spring elements are attached at the attachment points in a systematic arrangement by attachment point distance from the center in such a manner that should some of the spring elements reach the limit of elasticity, adjacent spring elements or spring elements of adjacent sets will not have reached the limit of elasticity.

12. A trampoline according to claim 5 wherein:

the bed has a plurality of spring attachment points where the spring elements connect to the bed; and some of the attachment points are closer to the center of the trampoline and other of the attachment points are farther from the center of the trampoline and spring elements are attached at the attachment points in a systematic arrangement by attachment point distance from the center in such a manner that should some of the spring elements reach the limit of elasticity, adjacent spring elements or spring elements of adjacent sets will not have reached the limit of elasticity.

13. A trampoline according to claim 5 wherein every spring element is tensioned more or less than the spring elements on either side of it.

14. A trampoline according to claim 5 wherein at least some of the spring elements comprise:

a spring; and a fastener element suitable to adjust the tension of the spring, the fastener elements of such spring elements having varied characteristics and being systematically arranged such that the tension of the spring elements or the travel distance required to reach the limit of elasticity of the spring elements is not uniform at every position and in such a manner that should some of the spring elements reach the limit of elasticity, adjacent spring elements or spring elements of adjacent sets will not have reached the limit of elasticity.

15. A trampoline according to claim 14 wherein:

the fastener element comprises a plurality V-rings of varied sizes, with one of the V-rings extending between the bed and the spring; and the V-rings of a plurality of spring elements are engaged in an arrangement such that the tension or the travel distance required to reach the limit of elasticity is systematically varied between at least some adjacent springs or between at least some adjacent sets of springs in such a manner that should some of the spring elements reach the limit of elasticity, adjacent spring elements or spring elements of adjacent sets will not have reached the limit of elasticity.

16. A trampoline according to claim 14 wherein:

the fastener element comprises a cam; and the cams of a plurality of spring elements have differing characteristics and are systematically arranged according to their characteristics in such a manner that the tension of the springs or the travel distance required to reach the limit of elasticity of the springs is not uniform at every position and such that should some of the spring elements reach the limit of elasticity, adjacent spring elements or spring elements of adjacent sets will not have reached the limit of elasticity.

17. A trampoline according to claim 14 wherein the fastener elements of a plurality of spring elements are positioned in an arrangement such that every spring is tensioned more or less than the spring on either side of it.

* * * * *